US007533781B1

(12) United States Patent
Spooner

(10) Patent No.: US 7,533,781 B1
(45) Date of Patent: May 19, 2009

(54) EXTRACTION FACILITATING CORK CLOSURE

(76) Inventor: James Spooner, 4204 Sky View Crest Rd., Albuquerque, NM (US) 87114

( * ) Notice: Subject to any disclaimer, the term of this patent is extended or adjusted under 35 U.S.C. 154(b) by 431 days.

(21) Appl. No.: 10/436,570

(22) Filed: May 13, 2003

Related U.S. Application Data

(60) Provisional application No. 60/319,259, filed on May 21, 2002.

(51) Int. Cl.
*B65D 39/00* (2006.01)

(52) U.S. Cl. ..... 215/297; 215/296; 215/302; 215/355; 215/364

(58) Field of Classification Search ..... 215/296–300, 215/364, 355, 363, 356, 302; D9/439
See application file for complete search history.

(56) References Cited

U.S. PATENT DOCUMENTS

| | | | | | |
|---|---|---|---|---|---|
| 190,579 | A | * | 5/1877 | Guild | 215/296 |
| 1,162,017 | A | | 11/1915 | Barrett | |
| 1,296,444 | A | * | 3/1919 | Webb | 215/299 |
| 2,046,224 | A | * | 6/1936 | Vanderhoof | 215/296 |
| 2,927,709 | A | * | 3/1960 | Hoffman et al. | 215/355 |
| 3,006,494 | A | * | 10/1961 | Reibeling | 215/355 |
| 3,307,727 | A | * | 3/1967 | Garay | 215/299 |
| 3,330,282 | A | * | 7/1967 | Visser et al. | 604/90 |
| 3,419,172 | A | * | 12/1968 | Lee | 215/44 |
| 3,559,834 | A | | 2/1971 | Taylor | |
| 3,970,207 | A | | 7/1976 | Faulstich | |
| 4,182,458 | A | | 1/1980 | Meckler | |
| 4,446,673 | A | * | 5/1984 | Desthieux | 53/467 |
| 4,893,636 | A | * | 1/1990 | Cook et al. | 600/577 |
| 5,060,812 | A | * | 10/1991 | Ogle, II | 215/247 |
| 5,297,561 | A | * | 3/1994 | Hulon | 600/577 |
| 5,636,757 | A | * | 6/1997 | Porvaznik | 215/364 |
| 5,722,548 | A | * | 3/1998 | Hojnoski | 215/299 |
| 5,868,264 | A | * | 2/1999 | Fulford et al. | 215/232 |
| 5,893,476 | A | * | 4/1999 | Esteron | 215/307 |
| D414,694 | S | * | 10/1999 | Richter | D9/439 |
| 6,029,836 | A | * | 2/2000 | Ligeras | 215/296 |
| 6,036,541 | A | * | 3/2000 | Koumatsu | 439/587 |
| 6,168,036 | B1 | * | 1/2001 | Teng | 215/296 |
| 6,241,112 | B1 | * | 6/2001 | Claessens et al. | 215/247 |
| D462,625 | S | * | 9/2002 | Martin | D10/46 |
| 6,568,549 | B1 | * | 5/2003 | Miller | 215/296 |
| 6,601,722 | B1 | * | 8/2003 | Litoux-Desrue et al. | 215/364 |
| 6,796,449 | B2 | * | 9/2004 | Fragola | 215/364 |

OTHER PUBLICATIONS

PTO'S Brief in In Re James Spooner Appeals No. 90-1372 (COAFC) and Final Ruling (1990).
H Kraus & H.D. Babbidge; Symptoms of Withdrawal; In CME (Dec. 1977).
Bernard M. Watney & Homer D. Babbidge; Corkscrews for Collectors, Philip Wilson Publishers Limited (1981).
Paul Fredericksen, Corkscrews That Work! In Wine Review; Wine Institutes San Francisco, USA (May 1946).

* cited by examiner

*Primary Examiner*—Anthony D Stashick
*Assistant Examiner*—Niki M Eloshway
(74) *Attorney, Agent, or Firm*—Jeffrey D. Myers; Peacock Myers, P.C.

(57) ABSTRACT

An improved cork closure for beverage and wine bottles having a recess on the exterior face of the closure in use. The recess is designed to facilitate the extraction process by providing central constraint on the position of the corkscrew on the face of the closure and to guide the corkscrew along the axis of the closure. This recess does not interfere with any other types of extraction device.

8 Claims, 3 Drawing Sheets

EXTRACTION FACILITATING CORK CLOSURE

CROSS REFERENCE TO RELATED APPLICATIONS

This patent application claims the priority from the provisional application 60/319,259 accorded with the filing date of May 21, 2002.

BACKGROUND OF THE INVENTION

Cylindrical cork closures are commonly used in wine bottles. Cut from natural cork, the closure is an elastic liquid-proof material that has a diameter that is slightly larger than the inner diameter of the neck of the bottle so that when it is compressed and inserted into the neck of the bottle it seals the bottle and forms a leak-proof closure. The closure is usually placed so that its outer face is essentially flush with the opening lip of the bottle. The closure may include a wrapper or capsule that covers the outer face of the closure and surrounds the neck to protect against contamination. With the advent of the cork, however, and especially where the cork was installed flush with the lip of the bottle, the need for extraction became the necessity for which the corkscrew was invented.

The traditional corkscrew in its simplest form is a metal helix or solid screw with an attached handle for manipulation. The corkscrew requires some skill in use with the objective being to withdraw the cork from the bottle whole and intact. An unsuccessful withdrawal can result in a broken cork that has to be dug out or pushed into the bottle. Either result is undesirable and is displeasing to the user. Other configurations of cork extractors have been developed over the years as described by Bernard Watney and Horner Babbidge in Corkscrews for Collectors (Philip Wilson Publications, London, England, 1981), but the helix or solid corkscrews still are the predominant tools.

Watney and Babbidge also describe the correct procedure and objectives for achieving a successful withdrawal. It requires (a) centering the axis of the corkscrew on the face of the exposed closure and (b) with a twisting motion advance it along the axis of the closure until sufficient material is engaged to permit withdrawing the closure without cracking or breaking the cork material. Deviation from these actions can result in the corkscrew advancing to the side of the closure where it becomes cramped against the neck of the bottle and may require additional force to withdraw or even bending of the corkscrew. At the very least this impairs the extraction by limiting further penetration and produces anxiety. Worse it may cause tearing or fracture of the cork requiring additional work to open the bottle and destroying the pleasure of the moment. And at worst, the glass of the bottle may be broken, making the wine unusable.

In the hands of a skilled user, these failures seldom occur, but even so do occur as described in the article "Corkscrews that Work" by Paul Fredericksen (Wine Review, May 1946). In the hands of a novice or occasional user, the rate will certainly rise, if not to a large number in absolute terms, then at least sufficient to cause some reluctance by the consumer in choosing a corked bottle. As evidence that the simple task of extracting a cork does challenge the user, observe the historical variety as described in *Corkscrews for Collectors*, and "Symptoms of Withdrawal" (H. Kraus and H. Babbidge, The Chartered Mechanical Engineer, Britain, December 1977) and U.S. patents as well as the current selection of devices on the market that address the problem of central positioning and guidance. Most achieve this result by providing a rigid housing that rides on the exposed lip of the bottle while holding the helix of the corkscrew in a central location with respect to the closure (Paul Fredericksen, Wine Review, May 1946). Yet the simple direct-pull and lever-pull corkscrews that rely upon the user's skill to centrally locate and axially guide the screw are still sold in abundance.

For fine wines that improve with age, the bottle will be laid down with the wine in contact with the inner surface of the closure to promote aging of the wine. The use of a cork is considered by many connoisseurs to be necessary for this purpose. Although aging is a very complex chemical process, one contributing mechanism is a very slow reaction in the wine over time, often years, as a result of permeation of a minuscule amount of oxygen through the cork material. Therefore, it is important that a bottle closure for wine bottles does not impede this process.

There are asymmetrically configured closures, such as for champagne and fortified wines, that require additional equipment on the bottling line. When such bottle closures are provided by their manufacturer to a winery, the winery must add collating or detecting equipment in the wine line for detecting their orientations prior to insertion in the bottles.

Recently, plastic materials have been developed that simulate natural cork and are being used for less expensive wine. For these simulated cork closures, objective (a) and (b) as described above are still active and this modification can be applied to them with the same benefits as described for natural cork.

Traditionally, the neck and mouth of the bottle are enclosed with a capsule that protects the outer face of the closure against contamination, but does not obstruct permeation of air. While this tradition is still in use, in recent years the capsule has been eliminated by some wineries in favor of a compressible plastic or wax plug placed and retained in the neck of the bottle covering the outer face of the closure. Because this plug not only protects the face of the closure, but also seals it against permeation, it is considered to be appropriate only for common wines that will not significantly benefit from extensive aging.

For the foregoing reasons, there is a need for a bottle closure that is able to guide the entering position and the advancing direction of the corkscrew in an extraction operation; there is a need for making a bottle closure that will not impede the permeation of air; and there is also a need that the bottle closure contains guiding mechanisms in both ends of the closure for the convenience of production.

SUMMARY OF THE INVENTION

It is accordingly the object of this invention to make improvements to closures for wine and other beverage bottles requiring auxiliary extraction devices to effect opening of the bottle. In one aspect of the invention, a centrally located guiding means is provided in the exterior face of the closure or the cylindrical body and provides positioning constraint to the tip of a conventional corkscrew during manual manipulation and guides the advancing direction of the corkscrew during the extraction process. The guiding means may be a single annular recess, a nipple-like projection, plural recesses of different diameters assembled according to their sizes, plural conic recesses assembled according to their sizes, multiple co-central annular rings or grooves, multiple separated holes, and multiple annular recesses positioned in an asymmetrical pattern, as fully explained below.

In another aspect, the improved bottle closure may have guiding means in each of its outer and inner surfaces of the cylindrical body, making it more cost-effective for the wine manufacturers to use pre-fabricated bottle closures. The presence of guiding means in the inner surface of the closure may incidentally increase the permeation of air under certain circumstances, and therefore facilitate the aging of wine when the bottle closure is used for wine.

In yet another aspect, the guiding means in the improved bottle closure may be plural cylindrical recesses of different sizes, with the largest recess being closest to the outer surface of the cylindrical body and the smallest one being closest to the inner surface of the body, the sizes of which are adapted to the varying diameters of commercially available corkscrews. Therefore, each recess may effectively constrain the central positioning and advancing direction of the corkscrew to which the recess is adapted. A user may use any of the commercially available corkscrews to withdraw the bottle closure.

The guiding means used in the improved bottle closure does not interfere with any other type of extraction devices, including those with metal positioning devices.

Those aspects and other aspects of the present invention will become apparent to those skilled in the art after a reading of the following detailed description of the invention together with the following drawings.

DETAILED DESCRIPTION OF THE INVENTION

The bottle closure of the present invention is an improved cylindrical cork closure, which is inserted into and approximately flush with the opening of the bottle. The modification is made to include in-place guiding means that assist the user in achieving two objectives for successful extraction of the closure: (a) constraining the tip of the helix so the axis of the corkscrew is at or near the center of the exposed face of the closure, (b) guiding the corkscrew to advance along the axis of the closure. Both of these actions will promote successful extraction of the closure from the bottle by the user, especially with simple corkscrew devices lacking mechanical means for assuring the desired central guidance. When the outer face of the closure is obstructed by a non-integral protective plug device, these guidance functions can be accomplished by incorporating the in-place guiding means onto the outer face of the plug device.

In simplest form objective (a) is achieved by providing a central depression or recess on the exterior face of the in-place closure. This recess is shaped to centrally position the axis of the corkscrew when the tip of helix is placed against the side of the recess. Additionally, the recess may be deepened or narrowed to provide lateral restraint on the advancing direction of the corkscrew as it advances into the cork, thus promoting objective (b).

Figure 1:
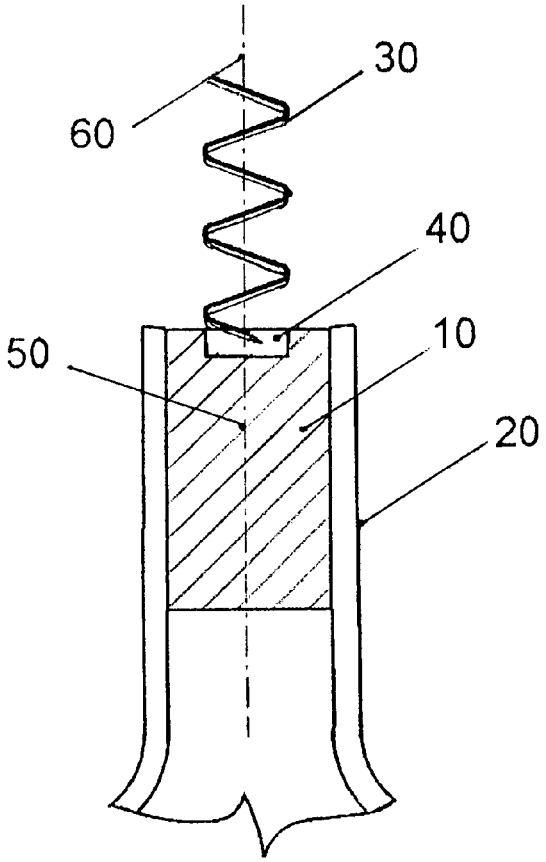
FIG. 1 is an axial section at the top portion of a corked bottle showing the bottle, a cylindrical body with a shallow cylindrical recess on one face of the body, and the relationship to the corkscrew in use.

Referring to FIG. 1, the cork closure 10 is shown in the neck of bottle 20 as in use. A centrally located shallow guiding means 40 (e.g., a cylindrical recess in this example) physically constrains the radial location of the tip of the entering corkscrew 30. The recess 40 also provides a constraint to the axis 60 of the corkscrew so that it is substantially coincident with the axis of the closure 50 when the corkscrew advances during extraction process. The depth need only be sufficient to engage the tip of the corkscrew or as little as 0.1 inches. The diameter of the recess should have a diameter of 0.3 to 0.4 inches to accommodate corkscrews in use or commercially available. Although the diameter of the recess and the diameter of the corkscrew may not match, departure of the axis of the corkscrew from the center of the closure is controlled and minimized.

Figure 2:
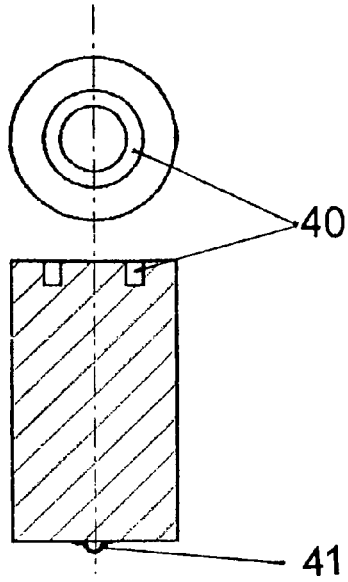
FIG. 2 shows a section through the longitudinal axis of the closure with an annular shallow recess.

One of the embodiments is shown in FIG. 2, where the guiding means 40 is a shallow annulus or ring in the exposed surface of the cylindrical body. This geometry provides central guidance more effectively than the open cylinder recess since the tip of the helix is constrained in two radial directions rather than one. The outer diameter will be the maximum diameter that can be expected for a helical corkscrew, or approximately 0.4-0.5 inches, and the inner diameter will match the smallest diameter to be encountered or about 0.25-0.3 inches. Thus, the width of the ring may be about 0.15-0.25 inches. However, the width of the ring can even be smaller, perhaps no more than 0.05 inches or just enough to engage the tip of the corkscrew. This will produce some central offset between the axis of the corkscrew and cork, but the offset will probably be less than 0.1 inches. Even a simple annular slit will be effective in grabbing and guiding the tip of the corkscrew. Because narrower widths constrain angular movement with respect to the axis of the closure, they lend lateral support for longitudinal guidance. Another embodiment shown in FIG. 2 is nipple 41, shown in the surface of the closure opposite recess 40.

Figure 3:
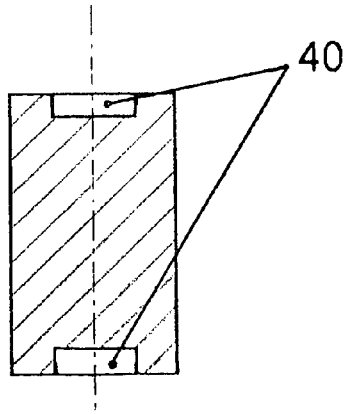
FIG. 3 is an axial section of the closure showing a recess on both faces of the cylindrical body.

In another version of the present invention, the guiding means 40 is located in both surfaces of the cylindrical body as shown in FIG. 3. The advantage presented by having guiding means 40 on both surfaces of the cylindrical body is that no modification of the bottling line is required. The closure manufacturer can provide the closure in this configuration and the winery can insert it with existing equipment without modification to the bottling line. Guiding means 40 will always be presented on the exposed surface while the guiding means 40 on the inner surface has no adverse effect on contained wine or beverage. This option is probably the least expensive of all alternatives for modified closures with an integral recess. While the closure will have the same height disposed within the bottleneck for effective sealing, it has a reduced distance between the inner and outer surfaces of the cylindrical body, promoting permeation and possibly resulting in accelerated aging of the contained wine.

Figure 4:
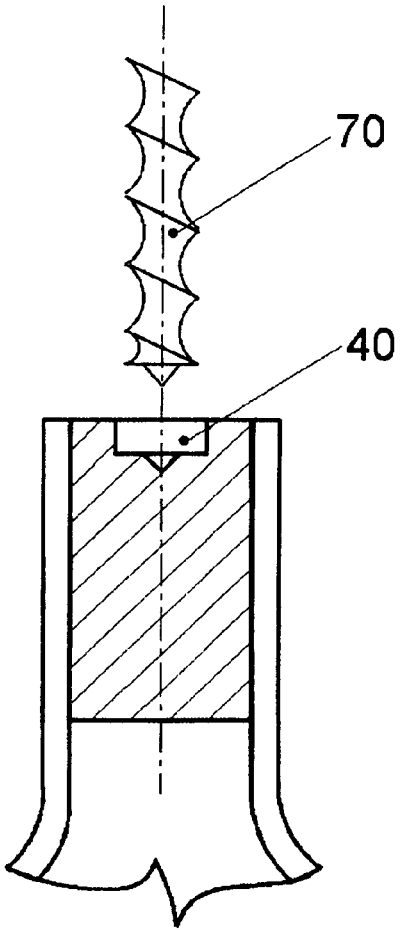
FIG. 4 is an axial section showing a v-shaped recess at the center of the floor of a shallow recess and the relationship to a screw-type corkscrew in use.
Figure 5:
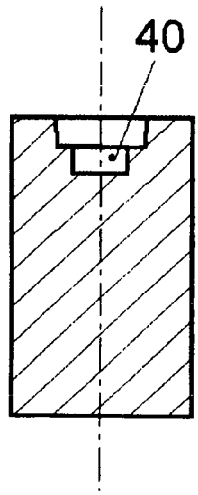
FIG. 5 is an axial section showing a smaller shallow cylindrical recess at the center of the floor of a shallow cylindrical recess.

In another embodiment of the present invention (FIG. 4), the guiding means 40 is multiple recesses that are adapted for both a helical and a screw-type corkscrew. The shallow cylindrical recess provides guidance for the helical structure while the additional centrally located v-shaped recess constrains the tip of the screw-type. In another embodiment of the present invention (FIG. 5), the guiding means 40 is a recess formed by multiple cylindrical recesses of different sizes. Since corkscrews are found in many sizes, each of the individual recesses is adapted to providing central guidance for a helical corkscrew of comparable size. The smallest recess is closest to the inner surface of the closure while the largest recess is close to the surface of the closure.

Figure 6:
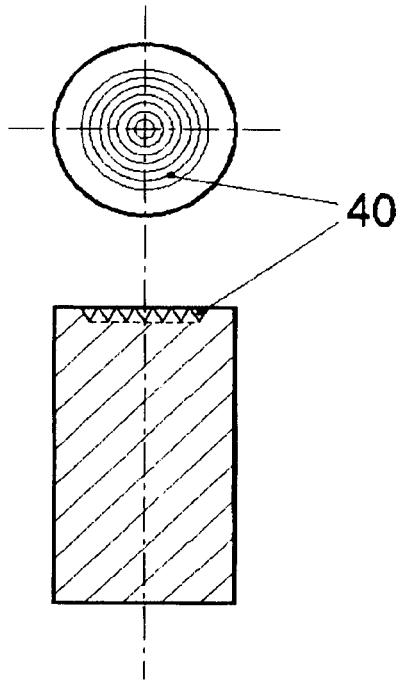
FIG. 6 is an axial section of the closure showing multiple v-shaped annular recesses on the outer face of the cylindrical body.
Figure 7:
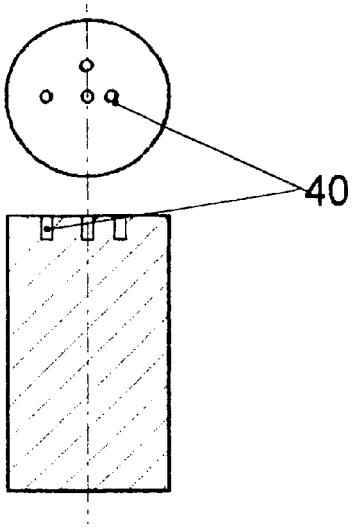
FIG. 7 is an axial section of the closure showing multiple separated holes located to engage the tip of the corkscrew at varying distances from the center of the closure.
Figure 8:
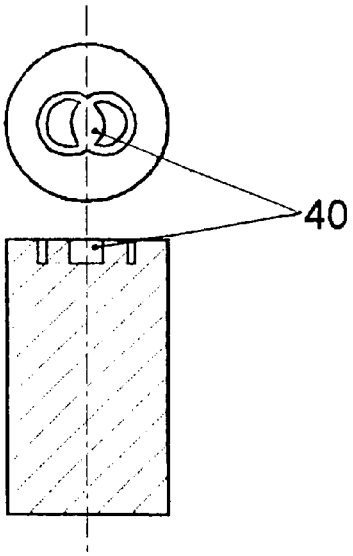
FIG. 8 is an axial section of the closure showing multiple annular recesses positioned in an asymmetrical pattern with the center of the cylindrical body.

There are many other variations of guiding means. FIG. 6 illustrates another embodiment of the improved bottle closure, where guiding means 40 is plural circular v-shaped or similar grooves. This improved bottle closure can be used with helical corkscrews of varying sizes as well as providing central constraint for the screw-type corkscrew. FIG. 7 shows guiding means 40, in the form of multiple small holes, located at an increasing distance from the center of the cylindrical body. These holes are large enough to engage the tip of the corkscrew and provide positioning for varying sizes of helical corkscrews as well as central positioning for the screw-type. FIG. 8 is an illustration of the diversity that guiding means 40 can take. It shows intersecting annular recesses that provide positioning for both the helical and the screw-type corkscrews. Those guiding means may be used with the embodiment shown in FIG. 3.

A recess can be readily drilled or burned into the exposed surface of an in-place unmodified cork closure as the bottle moves down the bottling line. This requires drilling and dust elimination machinery to be added after corking. Alternatively, if the recess is created on one surface only in the manufacturing process and supplied to the winery with the recess preformed, then the closure must be collated or machinery that detects the recess and positions of the closure prior to insertion in the bottle must be added to the bottling line.

Figure 9:
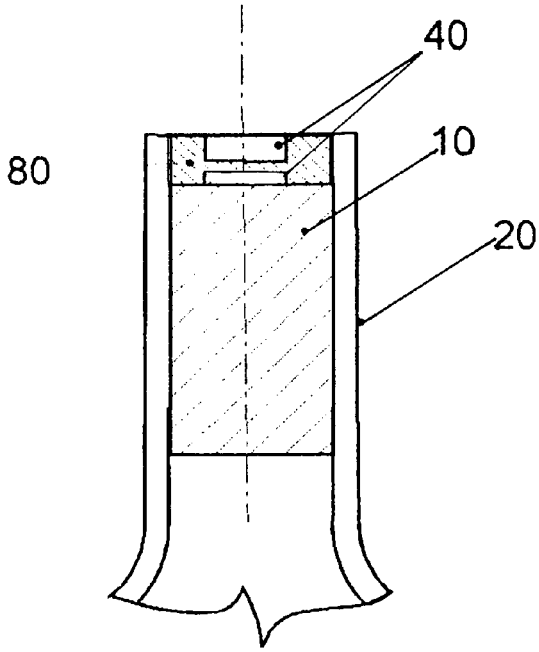
FIG. 9 is an axial section at the top portion of a corked bottle showing the bottle, a cylindrical body, and a plug with a shallow recess.

In a case where a disk-like plug is used, perhaps, to substitute for the capsule assembled above the cylindrical body, the plug modification shown in FIG. 9 will provide central guidance for the corkscrew tip. This figure shows the cork cylindrical body 10 in the neck of bottle 20 as it occurs in use. A centrally located shallow annular recess 40 in the plug 80 physically limits the radial location of the tip of the entering corkscrew. This configuration also guides the user in centrally locating the axis of the corkscrew coincident with the axis of the cylindrical body or the plug and helps the user keep the corkscrew in the axis of the cylindrical body during extraction process. Any of the guiding means previously disclosed for all embodiments shown from FIGS. 1 to 8 can be used with the plug. It is necessary only to limit the depth of the recess to a dimension less than the depth of the plug to assure that the face of the closure is protected.

If the disk-like plug is formed with plastic, it may be supplied by the manufacturer with a preformed recess in which case it would be beneficial to have it collated so that the recess need not be detected prior to insertion on the bottling line. Or, as with the bottle closure without a plug, the guiding means may be formed on both faces of the plug eliminating the need for collation. Only the guiding means in the outer face will perform the intended guiding functions while the guiding means in the inner face will not have any negative effect on the performance of the bottle closure. For those wineries already using this type of plug, either of these solutions appears to be preferable to drilling the recess on the bottling line since the plugging machines are in place and need not be modified.

As a way to emphasize the utility of the recess, the plug may be fabricated of two layers of differing colors or comprise of two component disks of same or different colors. The recess can then penetrate through one layer to expose the next so that the recess is visually located for the user.

If the plug is made of wax and it is formed in the bottling line by pouring molten wax into the bottleneck, an additional piece of machinery must be added to form the recess or the guiding means either by melting the wax or cutting.

The guiding means is incorporated in the outer face of the plug, but it is limited in depth to less than the plug thickness so the plug material remains intact over the face. The recess can be drilled, burned, or if formed with wax, melted into the plug with a hot template.

It is possible that shapes other than circular, such as square or hexagonal, could be used for the recess and still provide guidance and constraint for the tip of the corkscrew and might even give more lateral support than a cylindrical shape. However, the circular shape is the simplest and the easiest to form with readily available tools.

A significant and critical property of this invention (except the embodiment containing a nipple-like projection) is that there is no interference, modification, or prevention of use for any known cork extraction method or device and permeation is not impaired where that is a concern.

In those exemplary embodiments of the present invention, specific components and arrangements are used to describe the invention. Obvious changes, modifications, and substitutions may be made by those skilled in the art to achieve the same purpose of this invention. The exemplary embodiments are, of course, merely examples and are not intended to limit the scope of the invention. It is intended that the present invention cover all other embodiments that are within the scope of the appended claims and their equivalents.

What is claimed is:

1. A closure for a wine bottle opening comprising:

a cylindrical body comprising a compressible material having an outer surface and an inner surface, said cylindrical body disposable in the wine bottle opening;

a disk-shaped plug disposed on said outer surface of said cylindrical body, said disk-shaped plug comprising an outer face and an inner face and comprising a deformable material; and a corkscrew guide disposed in said outer surface of said disk-shaped plug, said guide comprising an annular recess having one outer opening, said opening smaller than the diameter of said outer surface and smaller than the inner diameter of the bottle opening, and said recess having at least two walls, at least one of said walls to constrain a tip of a corkscrew and to constrain radial positioning of the corkscrew as the corkscrew penetrates said disk-shaped plug, and a closed bottom surface of said recess, said bottom surface disposed in said recess between said outer face and said inner face of said disk-shaped plug; and wherein said recess is substantially disposed and centered in said outer face of said disk-shaped plug to accept and constrain a helix tip of the corkscrew during use of the corkscrew.

2. The closure of claim 1 wherein said disk-shaped plug comprises at least one material selected from the group consisting of wax, synthetic polymers, compressible materials, and a combination thereof.

3. In combination with a bottle for ingestible fluids, said bottle having an opening, a closure for said bottle opening, said closure comprising:

a cylindrical body comprising a compressible material having an outer and an inner surface and comprising a length of said closure from said outer surface to said inner surface, and said cylindrical body disposed in said bottle opening;

a corkscrew guide disposed in said outer surface of said cylindrical body, said corkscrew guide comprising a raised nipple having an outer diameter smaller than the inner diameter of the bottle opening and substantially centered on an axis of said cylindrical body, said nipple comprising a wall to radially constrain a tip of a corkscrew, and said nipple adapted to a helix of the corkscrew to constrain a central position of the corkscrew during use.

4. A closure for a wine bottle opening comprising:

a cylindrical body comprising a compressible material having an outer surface and an inner surface, said cylindrical body disposable in the wine bottle opening;

a disk-shaped plug disposed on said outer surface of said cylindrical body, said disk-shaped plug comprising:

an outer face and an inner face;

at least two component disks of different colors; and a deformable material, said deformable material comprising at least one material selected from the group consisting of wax, synthetic polymers, compressible materials, and a combination thereof; and a corkscrew guide disposed in said outer surface of said disk-shaped plug, said guide comprising a recess having one outer opening, said opening smaller than the diameter of said outer surface and smaller than the inner diameter of the bottle opening, and said recess having at least two walls, at least one of said walls to constrain a tip of a corkscrew and to constrain radial positioning of the corkscrew as the corkscrew penetrates said disk-shaped plug, and at least one of said walls comprising a closed bottom surface of said recess, said bottom surface disposed in said recess between said outer face and said inner face of said disk-shaped plug; and wherein said recess is substantially centered on an axis of said disk-shaped plug and the open face of said recess is adapted to a helix of the corkscrew to constrain a central position of the corkscrew during use of the corkscrew.

5. A closure for a wine bottle opening comprising:

a cylindrical body comprising a compressible material having an outer surface and an inner surface, said cylindrical body disposable in the wine bottle opening;

a disk-shaped plug disposed on said outer surface of said cylindrical body, said disk-shaped plug comprising an outer face and an inner face and comprising a deformable material; and a first corkscrew guide disposed in said outer surface of said disk-shaped plug, said first guide comprising a recess having one outer opening, said opening smaller than the diameter of said outer surface and smaller than the inner diameter of the bottle opening, and said recess having at least two walls, at least one of said walls to constrain a tip of a corkscrew and to constrain radial positioning of the corkscrew as the corkscrew penetrates said disk-shaped plug, and at least one of said walls comprising a closed bottom surface of said recess, said bottom surface disposed in said recess between said outer face and said inner face of said disk-shaped plug, and wherein said recess is substantially centered on an axis of said disk-shaped plug and the open face of said recess is adapted to a helix of the corkscrew to constrain a central position of the corkscrew during use of the corkscrew; and a second corkscrew guide disposed in said inner face of said disk-shaped plug.

6. A closure for a wine bottle opening comprising:

a cylindrical body comprising a compressible material having an outer surface and an Inner surface, said cylindrical body disposable in the wine bottle opening;

a disk-shaped plug disposed on said outer surface of said cylindrical body, said disk-shaped plug comprising an outer face and an inner face and comprising a deformable material; and a corkscrew guide disposed in said outer surface of said disk-shaped plug, said guide comprising:

a first recess having one outer opening, said opening smaller than the diameter of said outer surface and smaller than the inner diameter of the bottle opening, and said recess having at least two walls, at least one of said walls to constrain a tip of a corkscrew and to constrain radial positioning of the corkscrew as the corkscrew penetrates said disk-shaped plug, and at least one of said walls comprising a closed bottom surface of said recess, said bottom surface disposed in said recess between said outer face and said inner face of said disk-shaped plug; and a second, conical recess disposed and centrally positioned in said outer face of said plug; and wherein said first recess is substantially centered on an axis of said disk-shaped plug and the open face of said first recess is adapted to a helix of the corkscrew to constrain a central position of the corkscrew during use of the corkscrew disposed and centered in said outer face of said disk-shaped plug to accept and constrain a helix tip of the corkscrew during use of the corkscrew.

7. A closure for a wine bottle opening comprising:

a cylindrical body comprising a compressible material having an outer surface and an inner surface, said cylindrical body disposable in the wine bottle opening;

a disk-shaped plug disposed on said outer surface of said cylindrical body, said disk-shaped plug comprising an outer face and an inner face and comprising a deformable material; and a corkscrew guide disposed in said outer surface of said disk-shaped plug, said guide comprising a nipple or a recess, said recess having one outer opening, said opening smaller than the diameter of said outer surface and smaller than the inner diameter of the bottle opening, and said recess having at least two walls, at least one of said walls to constrain a tip of a corkscrew and to constrain radial positioning of the corkscrew to produce central guidance as the corkscrew penetrates said disk-shaped plug, and a closed bottom surface of said recess, said bottom surface disposed in said recess between said outer face and said inner face of said disk-shaped plug; and wherein said recess comprises at least one member selected from the group consisting of a cylindrical recess, multiple circles having a centered geometry, a plurality of recesses of different diameters assembled according to their sizes, a plurality of co-central annular rings assembled according to their sizes, a recess having an asymmetrical geometry, a plurality of v-shaped grooves assembled according to their sizes, multiple separated holes, multiple annular recesses positioned in an asymmetrical pattern, and a combination thereof; and wherein said nipple or recess is substantially disposed and centered in said outer face of said disk-shaped plug to accept and constrain a helix tip of the corkscrew during use of the corkscrew.

8. In combination with a bottle for ingestible fluids, said bottle having an opening, a closure for said bottle opening, said closure comprising:

a cylindrical body having an outer surface and an inner surface, said cylindrical body comprising a length of said closure from said outer surface to said inner surface and comprising a compressible material and disposed in said bottle opening; and a corkscrew guide disposed in said outer surface of said cylindrical body and said corkscrew guide comprising a cylindrical recess having one outer opening, said opening smaller than the inner diameter of said bottle opening and substantially centered on an axis of said cylindrical body, said recess having at least two walls, at least one of said walls to constrain a tip of a corkscrew and to constrain central positioning of the corkscrew on the outer surface of said cylindrical body during use of the corkscrew and one of said walls forming a closed bottom surface of said recess, said bottom surface disposed in said recess between said outer face and said inner face of said disk-shaped plug; and wherein said recess is adapted to a helix of the corkscrew to constrain a central position of the corkscrew during use of the corkscrew.

* * * * *